United States Patent [19]

Doderer-Winkler

[11] Patent Number: 4,994,010

[45] Date of Patent: Feb. 19, 1991

[54] METHOD AND APPARATUS FOR THE ATTACHMENT OF CLASPS TO LETTER ENVELOPES

[75] Inventor: Alfred Doderer-Winkler, Melsbach, Fed. Rep. of Germany

[73] Assignee: Winkler & Dunnebier Maschinenfabrik und Eisengiesserei KG, Neuwied, Fed. Rep. of Germany

[21] Appl. No.: 400,380

[22] Filed: Aug. 30, 1989

[30] Foreign Application Priority Data

Sep. 3, 1988 [DE] Fed. Rep. of Germany ..... 3830084

[51] Int. Cl.[5] ..... B31B 1/90; B31B 21/36

[52] U.S. Cl. ..... 493/215; 493/385

[58] Field of Search ..... 493/214, 215, 383, 384, 493/385, 392

[56] References Cited

U.S. PATENT DOCUMENTS

| | | | |
|---|---|---|---|
| 1,114,178 | 10/1914 | Olm | 493/215 |
| 1,508,467 | 9/1924 | Novick | 493/392 |
| 1,556,369 | 10/1925 | Stiriss | 493/215 |
| 1,931,155 | 10/1933 | Pearce | 493/392 |
| 2,269,954 | 1/1942 | Novick | 493/392 |
| 3,893,381 | 7/1975 | Chapman et al. | 493/392 |

FOREIGN PATENT DOCUMENTS

| | | |
|---|---|---|
| 3816013 | 8/1989 | Fed. Rep. of Germany . |
| 3805388 | 11/1989 | Fed. Rep. of Germany . |

*Primary Examiner*—William E. Terrell

*Attorney, Agent, or Firm*—Collard, Roe & Galgano

[57] ABSTRACT

There is provided a method and apparatus for the attachment of clasps on letter envelopes incorporated into a machine for the manufacture of letter envelopes. The clasps, at the conclusion of the folding operation of the envelope machine, following the folding down of the lateral flaps of the envelope, are attached to the newly formed back sides of the letter envelopes. The apparatus is arranged for this purpose at the downstream end of a lateral folding mechanism of the envelope machine and includes a stationary opposing support plate.

25 Claims, 10 Drawing Sheets

METHOD AND APPARATUS FOR THE ATTACHMENT OF CLASPS TO LETTER ENVELOPES

The present invention relates to a method and apparatus for the attachment of clasps to letter envelopes used in combination with a machine to manufacture letter envelopes. More particularly, the present invention relates to such a method and apparatus for the attachment of metal clasps in accordance with German patent documentation P No. 38 05 388. The clasps are attached to letter envelopes which are moved in a direction of conveyance during their manufacture, such that the clasps which have anchoring elements, come from a supply magazine in uninterrupted succession and are advanced by a feeding mechanism to an embossing roller and are affixed to the back sides of the letter envelopes which are formed by the folding of lateral flaps of the envelope blanks and are secured thereto together with their anchoring elements by means of an opposing support plate.

The above described clasps are used to maintain locking flaps of letter envelopes, in particular, mailer envelopes, in a sealed position on the back side of the letter envelope. Prior to the present invention, such clasps were either attached by means of separate devices or devices which were incorporated into the letter envelope machine subsequent to or nearly subsequent to the manufacturing process, so that low production efficiency and low product quality resulted.

A method is disclosed in U.S. Pat. No. 2,269,954, to Novick, granted Jan. 13, 1942, whereby clasps and eyes are arranged on mailing envelopes manufactured on letter envelope machines in order to seal said envelopes. However, according to the Novick patent this is accomplished by means of a special machine extraneous to the manufacturing process of the mailer envelopes.

In addition, U.S. Pat. No. 3,893,381, to Chapman et al., granted July 8, 1975 discloses a special apparatus whereby the mailing envelopes are fed transversely, with sealing flaps open, to the direction of conveyance through the apparatus and an anvil plate is inserted from the side into the interior of the mailing envelope in order to serve as the opposing support plate for the mechanism used to attach a wing clap supplied from above. Such a device, however, does not lend itself to incorporate into the machine for the manufacturing of mailing envelopes because in this process the mailing envelopes are advanced through the manufacturing machine with their sealing flaps directed backwards to the direction of movement. Thus, the mailing envelopes must be rotated 90° during their manufacturing process in order to use this apparatus in a machine used to manufacture letter envelopes. The expense associated with such an alternation is too great and not justifiable.

German patent document No. 38 16 013.7 discloses an apparatus which is incorporated into a manufacturing machine such that the mailing envelope is fed through the device with its sealing flap directed to the rear in the direction of movement. With this device the wing clasps are affixed by means of a drum-shaped attaching mechanism to the back sides of the mailing envelopes and anchored there by means of opposing support plates. The opposing support plates int he form of toggle levers, are placed by an intermittent movement into the mailing envelopes from behind. For this purpose the toggle levers re arranged on a chain belt which revolves in the plane of conveyance of the mailing envelopes and which chain belt is guided around guide wheels. A disadvantage of this solution is the fact that, in view of the desired utilization of production capacity of the manufacturing machine, the mailing envelopes have to be advanced through said mechanism in staggered fashion, that is, at a slower speed of conveyance, in order that, at the intermittent sequence of movement, the toggle levers can be placed as opposing support plates into the interior areas of the mailing envelopes. This, of course, necessitates increasing mechanical cost. It is also disadvantageous in that considerable means, for example, guide curves for the toggle levers, controlled compressed air to open the mouth of the respective mailing envelope, etc. so that a reasonably reliable telescoping of a toggle lever into the respective mailing envelope is possible. Such means notwithstanding, it occurs time and again with such a mechanism that a toggle lever does not telescope properly into the interior of the mailing envelope but, rather, between two mailing envelopes. This results in production stoppage and rejects.

A common, serious disadvantage of all previously known mechanisms in the art for attaching clasps is the fact that they can only be utilized at points during the production process which are traversed by the finished or almost finished mailing envelopes in a succession of equally spaced individual pieces. Such mechanisms, however, cannot be utilized on the track of path control system in which the cutting to shape and folding of the lateral flaps of what will later be the mailing envelopes is already implemented on a continuous track prior to separation of the mailing envelopes into individual segments.

Starting with the present state of the art, the object of the present invention is to provide a method and apparatus for the attachment of clasps to letter envelopes which is incorporated into the envelope manufacturing machine and which makes it possible to attach clasps, in particular clasps according to German patent document P No. 38 05 388, to letter envelopes during the production process, such that the apparatus can be utilized both in path control and blade machines. Moreover, it is intended that attaching the claps should not interfere with the production process nor compromise the production performance of the manufacturing machine.

In addition, the design according to the present invention intended to be simple, cost effective, easy to operate and, above all, reliable in order to obviate operational breakdowns to the greatest extent possible.

The above object is accomplished in accordance with the present invention wherein, in accordance with the method therefor, the clasp having anchoring elements is fed in an uninterrupted succession with other clasps from a supply magazine and advanced by a feed mechanism to an embossing roller and affixed thereby and secured by means of an opposing support plate to the back side of a letter envelope subsequent to the folding of the lateral flaps thereof to form the backside of the letter. The apparatus includes an advancing mechanism having a guiding and separating device, an embossing roller and an opposing support plate, wherein the embossing roller and opposing support plate are stationary and disposed at a fixed spatial relationship to each other at the downstream end of the lateral flap-folding mechanism of the envelope making machine.

The benefit realized by the present invention leis particularly in the fact that during the course of manufacturing of the letter envelopes, during formation of the inner pouch, that is to say, while the back side of the letter envelope is being formed by the folding of the lateral flaps, the clasps can be attached to the newly formed back side. By virtue of the disposition of the apparatus of the present invention at this preferred location in the manufacturing process it is possible, in contrast to other apparatus heretofore known in the art, to operate with a single stationary, simple opposing support plate. The resulting apparatus is cost effective, straightforward, sturdy and not susceptible to operational breakdown and is easy to operate. It is also possible to attach the clasps reliably registry-accurate to the letter envelope without additional relative movement of the opposing support plate. It should also be pointed out that by virtue of attaching the clasp at the point in the production process that the gummed seams of the lateral flaps of the envelope are folded onto each other, the lateral flaps are fixed with respect to each other so that, prior to the glue setting, slippage of the lateral flaps against each other is effectively prevented.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
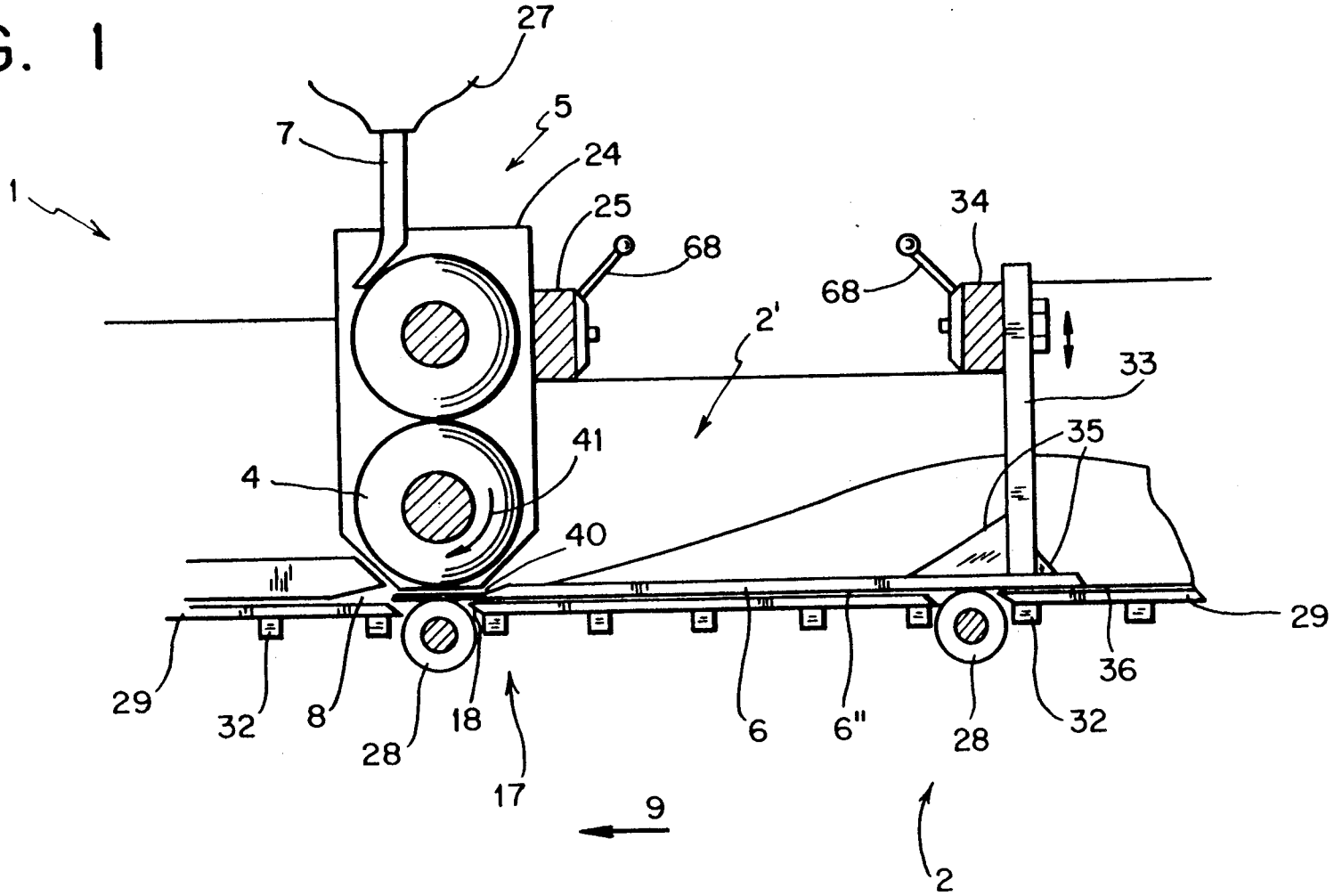
FIG. 1 is a diagrammatic side view of the apparatus according to the present invention.

When a clasp 19 is attached to the back side 12 of a letter envelope 10, the problem of placing an opposing support plate 6, which opposing support plate is required to attach the clap 19 by means of a stamping operation, between the front side 11 and the back side 12 of the envelope, that is, into the interior of the letter envelope 10 must be solved.

Figure 2:
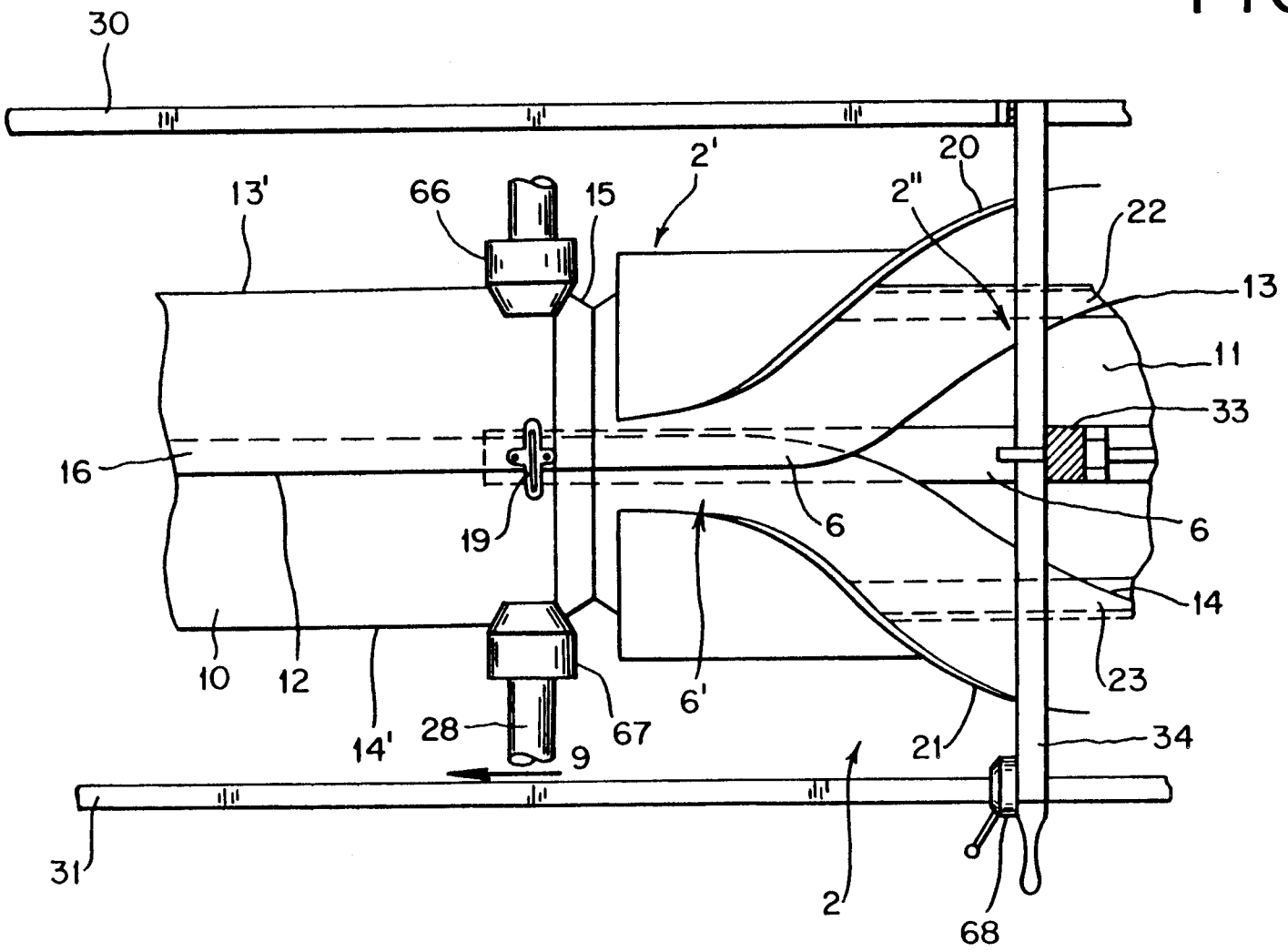
FIG. 2 is a top view of the apparatus of FIG. 1, without the embossing roller and feed mechanism.
Figure 3:
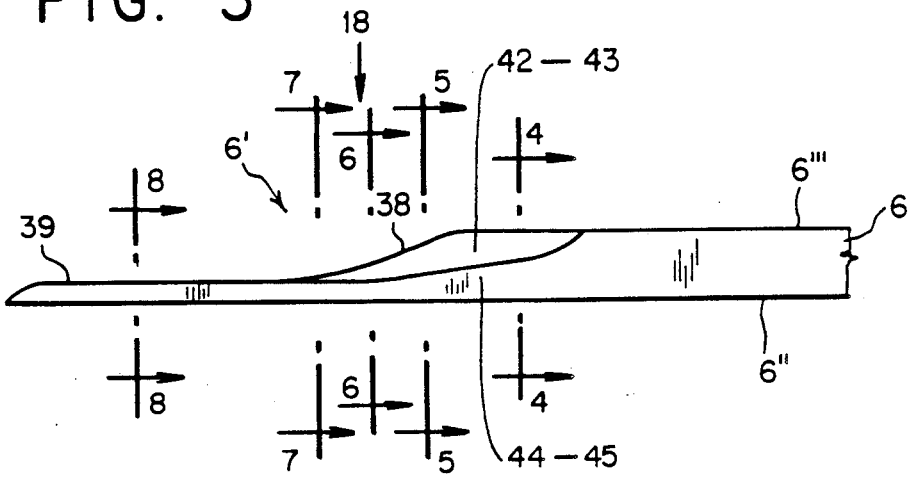
FIG. 3 is a cross-sectional view of an opposing support plate.
Figure 4:
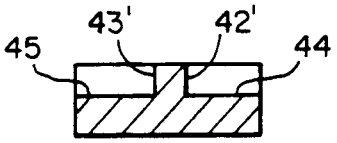
FIG. 4 is a cross-sectional view of the opposing support plate of FIG. 3 taken along line IV—IV of FIG. 3.
Figure 5:
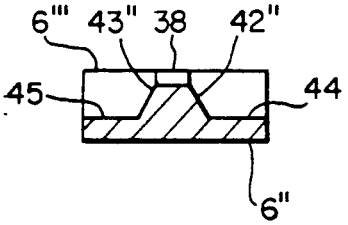
FIG. 5 is a cross-sectional view of the opposing support plate of FIG. 3 taken along line V—V of FIG. 3.
Figure 6:
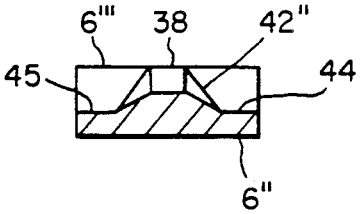
FIG. 6 is a cross-sectional view of the opposing support plate of FIG. 3 taken along line VI—VI of FIG. 3.
Figure 8:
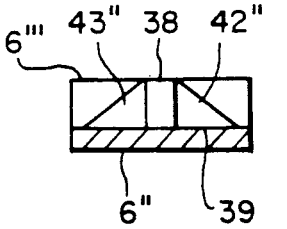
FIG. 8 is a cross-sectional view of the opposing support plate of FIG. 3 taken along line VIII—VIII of FIG. 3.
Figure 7:
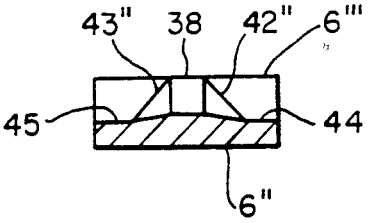
FIG. 7 is a cross-sectional view of the opposing support plate of FIG. 3 taken along line VII—VII of FIG. 3.

With almost all machines used today to manufacture letter envelopes 10, the letter envelopes are guided through the machine in the position shown in FIG. 2, that is, in a position in which the sealing flap 15 lies to the rear with respect to the direction of conveyance 9. They traverse in the process a lateral flap-folding mechanism 2 during which their lateral flaps 13 and 14, with the assistance of fold loops 20 and 21 and folding blades 22 and 23, are folded onto each other. During this operation, lateral flaps 13 and 14 converge and are glued together in an overlapping area 16 by means of an adhesive layer which has been previously applied with the result that together they form back side 12 of envelope 10. Folding edges 13' and 14' created in the process are thereupon pressed down and fixed by folding rollers 66 and 67 which act against a roller 28. During the folding operation front side 11 of letter envelope 10 is held flat in a plane of conveyance 8.

The invention profits from this circumstance such that, as is shown in FIGS. 1 and 2, the aforementioned paper guide is configured as a stationary opposing support plate 6 for an apparatus 1 for the attachment of clasps 19, whereby apparatus 1 is arranged at downstream end 2' of lateral flap-folding mechanism 2. During this folding operation, opposing support plate 6 is gripped in tube-like manner at its downstream end 6' by front side 11 and back side 12 of envelope 10, such that overlapping area 16 glides with respect to end area 6'. Clasps 19 which issue from a supply bin 27, are fed via a feed mechanism 5 to a gripper mechanism 4'' of a rotating embossing roller 4. Embossing roller 4 conveys clasp 19 to letter envelope 10 in a curving movement, presses anchoring elements 19' through overlapping area 16 of the envelope and, with the help of opposing support plate 6, bends anchoring elements 19' over in such a way that the latter come to bear securely on the inner side of back side 12, fixing, in this way, clasp 19 to the back side 12 of envelope 10.

As shown in the drawings, letter envelopes 10 are conveyed by rollers 28 and guide plate 29 which define the plane of conveyance 8 of the letter envelopes. To this end, rollers 28 rotate in side walls 30 and 31 of lateral flap-folding mechanism 2 while guide plates 29 are solidly connected by traverses 32 to side walls 30 and 31. At downstream end 2' of lateral flap-folding mechanism 2, at a distance to the plane of conveyance 8 and in axis-parallel alignment to roller 28, embossing roller 4 pivots in a frame 24. In frame 24, feed mechanism 5 is also arranged. Frame 24, in turn, is solidly connected by a traverse support 25 to side walls 30 and 31.

Opposing support plate 6 has a vertical fixture 33 by means of which the support plate, in an area 2'' inside lateral flap-folding mechanism 2, in which lateral flaps 13 and 14 do not yet overlap, is bolted to a transverse support 25 which, in turn, is secured to side walls 30 and 31. Opposing support plate 6 is rigidly connected to vertical fixture 33 by means of stiffeners 35. It extends, in the form of a strip, in parallel alignment to side walls 30 and 31 and to plane of conveyance 8, out of are 2'' through and into an area between embossing roller 4 and roller 28, whereby it defines, with its underside 6'' through to the plane of conveyance 8, a guiding gap 36 for the front side 11 of letter envelope 10. Downstream end 6' of opposing support plate 6, as can be appreciated in FIGS. 3 through 8, is, in conformity with embossing roller 4, configured as an anvil 18. In this configuration, support plate 6 tapers from its top side 6''' by means of an inner curvature 38 adapted to embossing roller 4 to a final flattening 39. Inner curvature 38 of support plate 6 and outer casing 4' of embossing roller 4 define a working gap 40 for back side 12 of letter envelope 10. Working gap 40 can be adjusted through vertical displacement of frame 24 on transverse support 25. Anvil 18 has two curve-shaped guide surfaces 42 and 43. The latter connect inner curvature 38 to curved recesses 44 and 45 and, together with inner curvature 38 and recesses 44 and 45 evolve over into final flattening 39. Guide surfaces 42 and 43 with their intake-surfaces 42' and 43' are vertically aligned with respect to top side 6''' and are parallel to each other. From this position they evolve over as depicted in FIGS. 4 through 8, through inverse progressive rotation, through outwardly slanting transition zones 42'' and 43'', into final flattening 39 which is parallel alignment with top surface 6''' and outer casing 4'.

Transverse supports 25 and 34 are pivotally articulated on side wall 30 and secured in detachable manner to side wall 31 by means of bolting elements 68. This configuration enables the entire apparatus 1 to be tilted out when not in operation.

Figure 9:
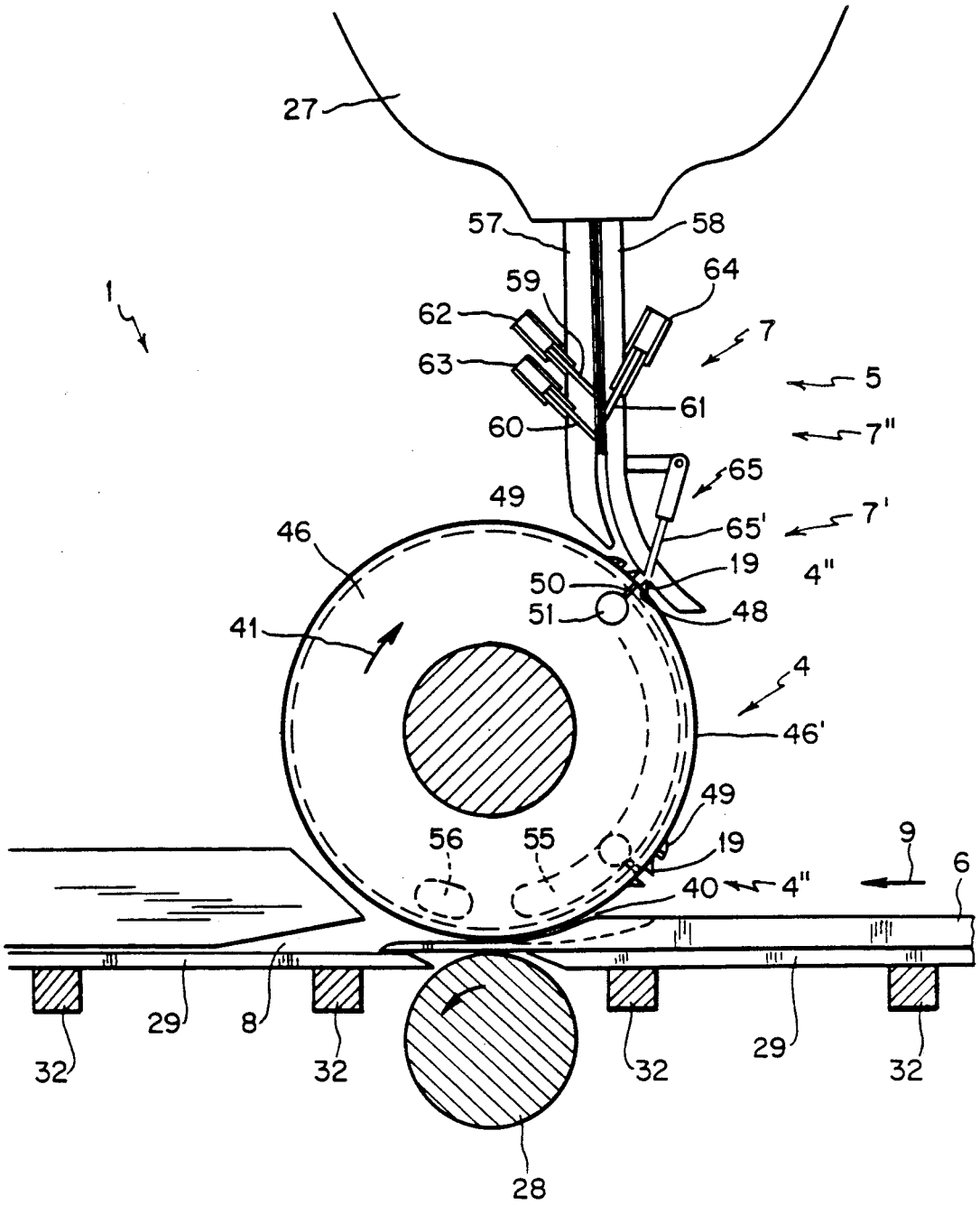
FIG. 9 is a side view of a second embodiment of the invention with an elementary clasp feed.
Figure 10:
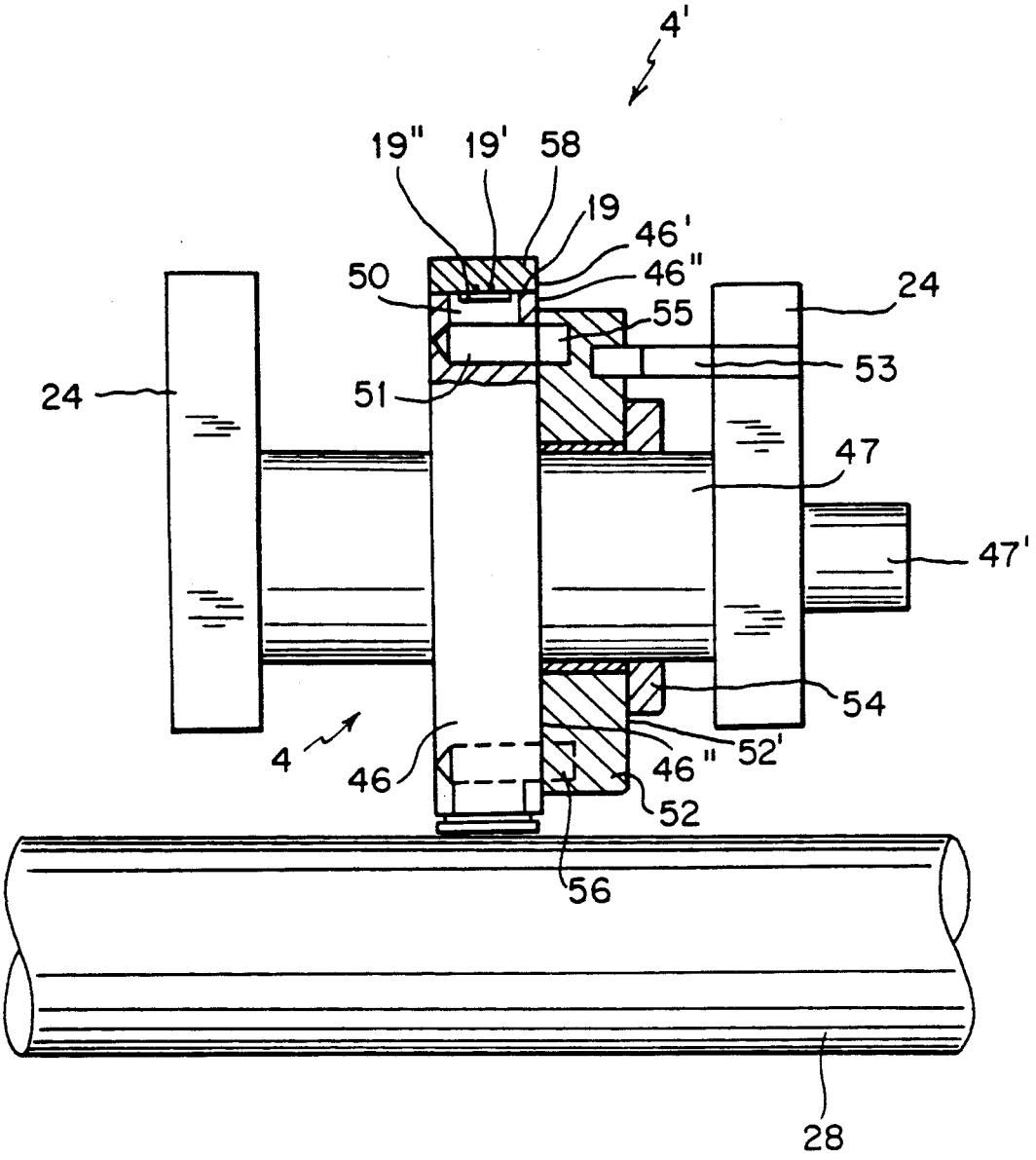
FIG. 10 is a cross-sectional view of the device shown in FIG. 9.

As shown in FIGS. 9 and 10, embossing roller 4 includes a disk-shaped rotation body 46 which sits, in fixed position, on an axis 47 which rotates in a frame 24. Axis 47 is equipped with a driving pin 47' upon which a drive (not shown) delivered by the machine, acts. By means of this drive, embossing roller 4 can be both continuously and discontinuously driven. As regard the drive, it is only crucial that during attachment of the clasp, synchronization between letter envelope 10 and clasp 19 exist. Rotation body 46, on its casing 46', exhibits a flattening 48 on whose upstream end and a lug-shaped entrainment means 49 is arranged. Flattening 48 exhibits additionally an axially aligned vacuum slot 50 which, serving as an air conduit, is connected to a blind bore 51 which extends axially in rotation body 46. Vacuum slot 50 is configured in such a way that it also serves as a form-locking mechanical seat to receive a back bead 19'' of clasp 19. Blind bore 51 is open toward one side 45'' of rotation body 46. On axis 47 a control valve 52 for vacuum air is located on the front side on side 46''. Control valve 52 is held in fixed position vis-a-vis frame 25 by means of a fixture 53 which it is connected to axis 47 is a freely rotating manner, on which axis it is axially prevented from displacement by means of an adjusting ring. Radially arranged on a side 52' of control valve 52 which faces side 46'' are a vacuum air duct 55 which serves as an air conduit and is connected to a vacuum air source (not shown) and a duct 56 for equalization of atmospheric pressure. Ducts 55 and 56 are the same distance to the rotational center of axis 47 as blind bore 51. During operation, blind bore 51 rotates beyond ducts 55 and 56, as indicated by the dot-dash lines. IN the process, the vacuum slot, in order to seize and release clasp 19, is pressurized alternately with vacuum and compressed air.

Figure 15:
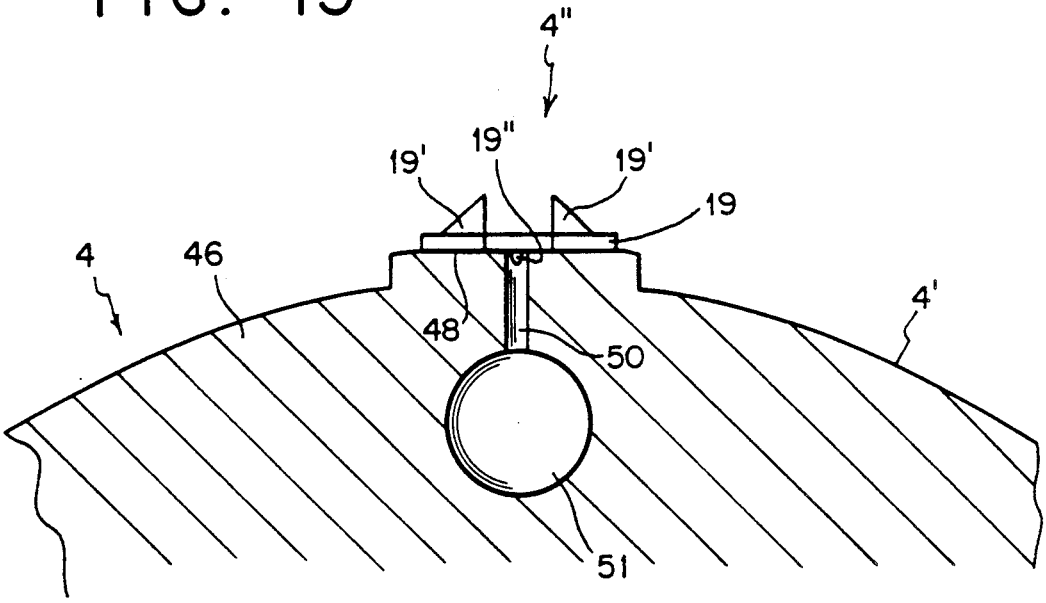
FIG. 15 is a cross-sectional view of the embossing roller.
Figure 16:
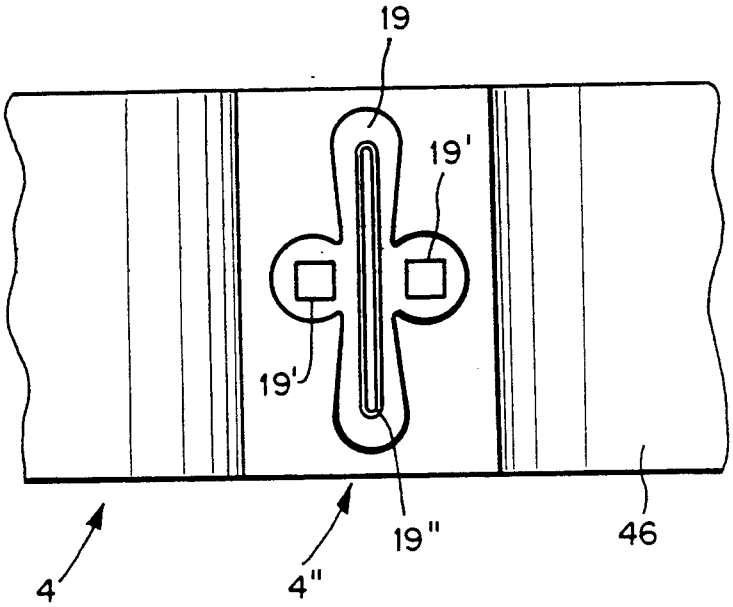
FIG. 16 is a cross-sectional view of the casing of the embossing roller.

During discontinuous operation the embossing roller preferably exhibits, as shown in FIGS. 15 and 16, the full outside diameter only in the area of its gripper mechanism 4''. The remainder of the outer casing 4' is reduced in diameter so that working gap 40 becomes larger, permitting the unobstructed passage of back side 12 of envelope 10. For this reason, embossing roller 4, in an extreme case, can be configured as a rotating segment.

Feed mechanism 5 for clasps 19 consists, in its simplest form, of a guide 7 by means of which clasps 19, issuing from a supply bin 27 in an uninterrupted succession, are fed tangentially to embossing roller 4. Guide 7 is formed from two equidistant parallel guides 57 and 58, whereby guide 58 exhibits a transverse groove 58' to receive anchoring elements 19' of clasp 19. Guide 58 can thereby serve at the same time over a short stretch as the top guide for clasp 19 suctioned on flattening 48 of embossing roller 4. In downstream terminal area 7'' of guide 7, in the direction of conveyance of clasp 19, two vacuum jets 59 and 60 are arranged in guide 57, one after the other and at a sharp angle to the direction of conveyance, whose distance to each other is greater than one and smaller than two clasp lengths "d". Vacuum jets 59 and 60 are supplied via conduits 62 and 63, respectively, with separately controlled vacuum from a vacuum source (not shown). Axially to vacuum jets 59 and 60 and at a sharp angle to the direction of conveyance a compressed air jet 61 is arranged in the guide 58 which can be pressurized via a conduit 64 with controlled compressed air from a compressed air source (not shown). Downstream from compressed air jet 61, almost at the tangential point between embossing roller 4 and guide 7, a brake mechanism 65 in the form of a brush 65' is arranged on guide 58.

Clasps 19 are sorted by means of a vibrating mechanism (not shown) which is incorporated into supply bin 27, formed into a row, and conveyed into guide 7 and therein, by means of the vacuum and compressed air jets 59, 60 and 61, arranged singly, as follows:

In an initial phase, vacuum jet 60 which has been pressurized with vacuum, hold back the entire row of clasps. Vacuum jet 59 in the meantime is pressurized with compressed air. Thereafter, vacuum is switched to vacuum jet 59 and vacuum jet 60 is supplied with compressed air. Vacuum jet 59 holds back the row of clasps, except for the lowermost clasp 19 which is blasted downward by the momentarily activated compressed air jet 61 in guide 7 until it is acted upon by brake mechanism 65. At this point, clasp 19, now separated, by means of vacuum, is taken in charge by embossing roller 4, on its flattening 48, and, at the same time, aligned on entrainment means 49 in the register with the result that clasp 19, with its back bead 19'', is taken up in vacuum slot 50. Clasp 19 is thereupon advanced from embossing roller 4 to the back side 12 of letter envelope 10 which is fed through working gap 40 between embossing roller 4 and anvil 18. At the same time, anchoring elements 19' piece the back side 12 of the letter envelope, coming in contact with both guide surfaces 42 and 43 of support plate 6. By means of guide surfaces 42 and 43, anchoring elements 19' are, during the rotating movement of embossing roller 4, gradually bent outward while the clasp continues to remain fixed on embossing roller 4. At the moment anchoring elements 19' reach final flattening 39 of support plate 6, they have come to bear completely on the inner side of back side 12 of envelope 10. Clasp 19 is, as a result thereof, firmly anchored in back side 12 and is thereupon released by embossing roller 4.

Figure 11:
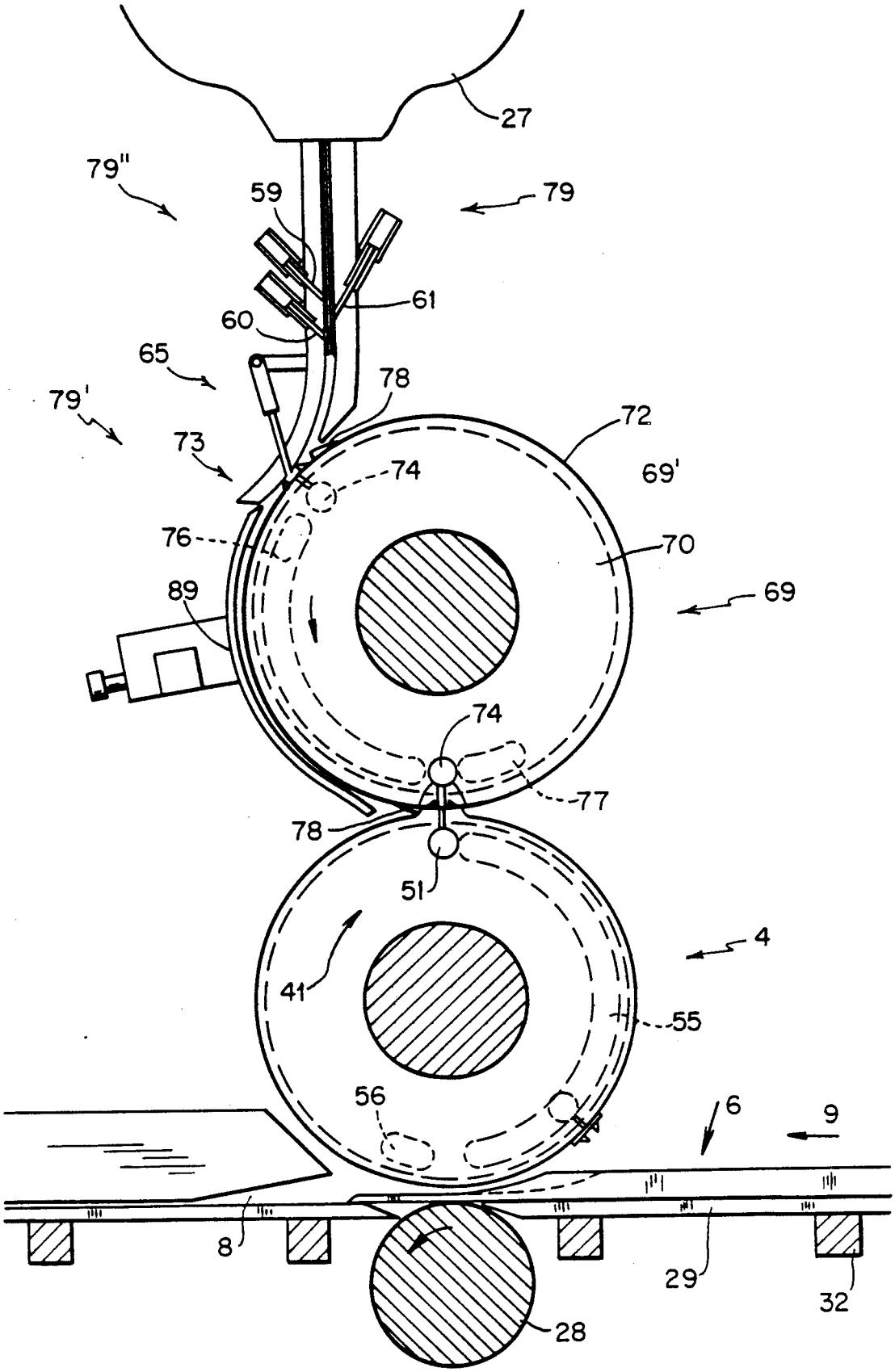
FIG. 11 is a side view of a third embodiment of the invention with regulating cylinder.
Figure 12:
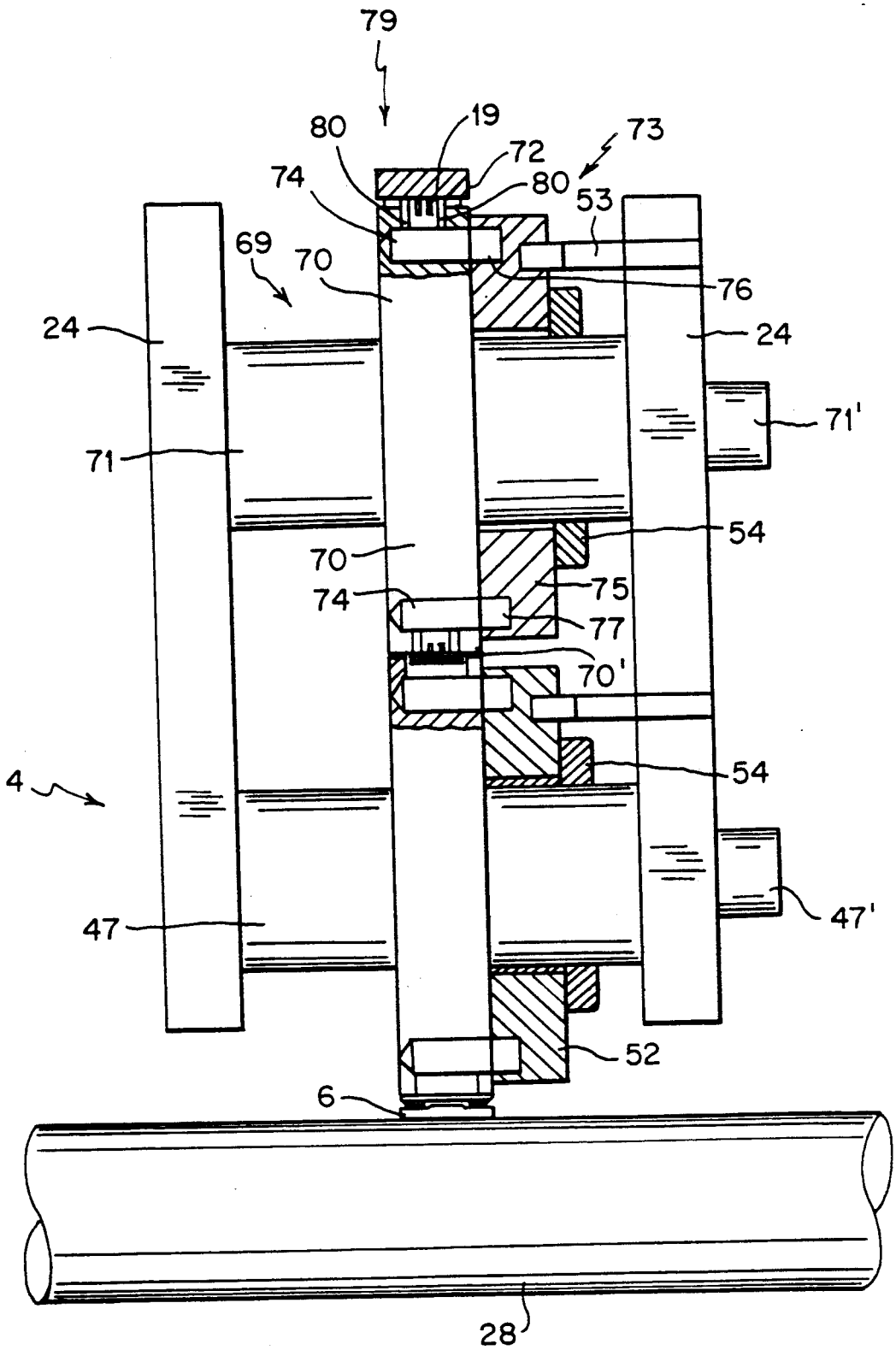
FIG. 12 is a cross-sectional view of the device shown in FIG. 11.

In a second embodiment of apparatus 1, feed mechanism 5 additionally exhibits, as can be seen in FIGS. 11 and 12, a regulating cylinder 69 which is arranged between a slightly modified guide 79 and embossing roller 4 and which, on one side, is equipped with a stationary protective device 89. Regulating cylinder 69 is formed by a rotational body 70 which sits, in fixed position, on an axis 71 which rotates in frame 24. Axis 71 is equipped with a driving pin 71' upon which a drive (not shown) acts. The drives of regulating cylinder 69 and embossing roller 4 are connected in phase but can be adjusted with respect to each other. Rotational body 70 exhibits an annular groove 72 to receive anchoring elements 19' as well as a vacuum gripper mechanism 73 to seize clasp 19. At the upstream end of vacuum gripper mechanism 73 a lug-shaped entrainment means 78 is arranged for the purpose of aligning clasp 19. Vacuum gripper mechanism 73 consists of two vacuum bores 80 which are arranged on both sides of annular groove 72 and which, serving as an air conduit, is connected to a blind bore 74. Blind bore 74 is open toward one side 70' of rotational body 70. On axis 71 a control valve 75 for vacuum is located on the front side on side 70'. Control valve 75 is held in fixed position vis-a-vis frame 24 by means of a fixture 53 while it is connected to axis 71 in a freely rotating manner, on which axis it is axially prevented from displacement by means of an adjusting ring 54. Control valve 75, similar to control valve 52, exhibits a vacuum duct 76 and a duct 77 for compressed air, which ducts are supplied from sources not shown and which ducts are alternatingly connected to blind bore 74. Gripper mechanism 73, during the rotational movement of regulating cylinder 69, consequently, is alternatingly pressurized with vacuum and compressed air. Clasp 19, having been delivered in separated form by guide 79 is seized by means of vacuum and aligned at the same time on entrainment means 78, whereupon, having been aligned, it is turned over to embossing roller 4. With gripper mechanism 4'' of embossing roller 4, entrainment means 49 can, in this instance, be dispensed with, in which case gripper mechanism 4'' displays the form shown in FIGS. 15 and 16. The attaching of clasp 19 to letter envelope 10 is effected as described hereinbefore.

Figure 13:
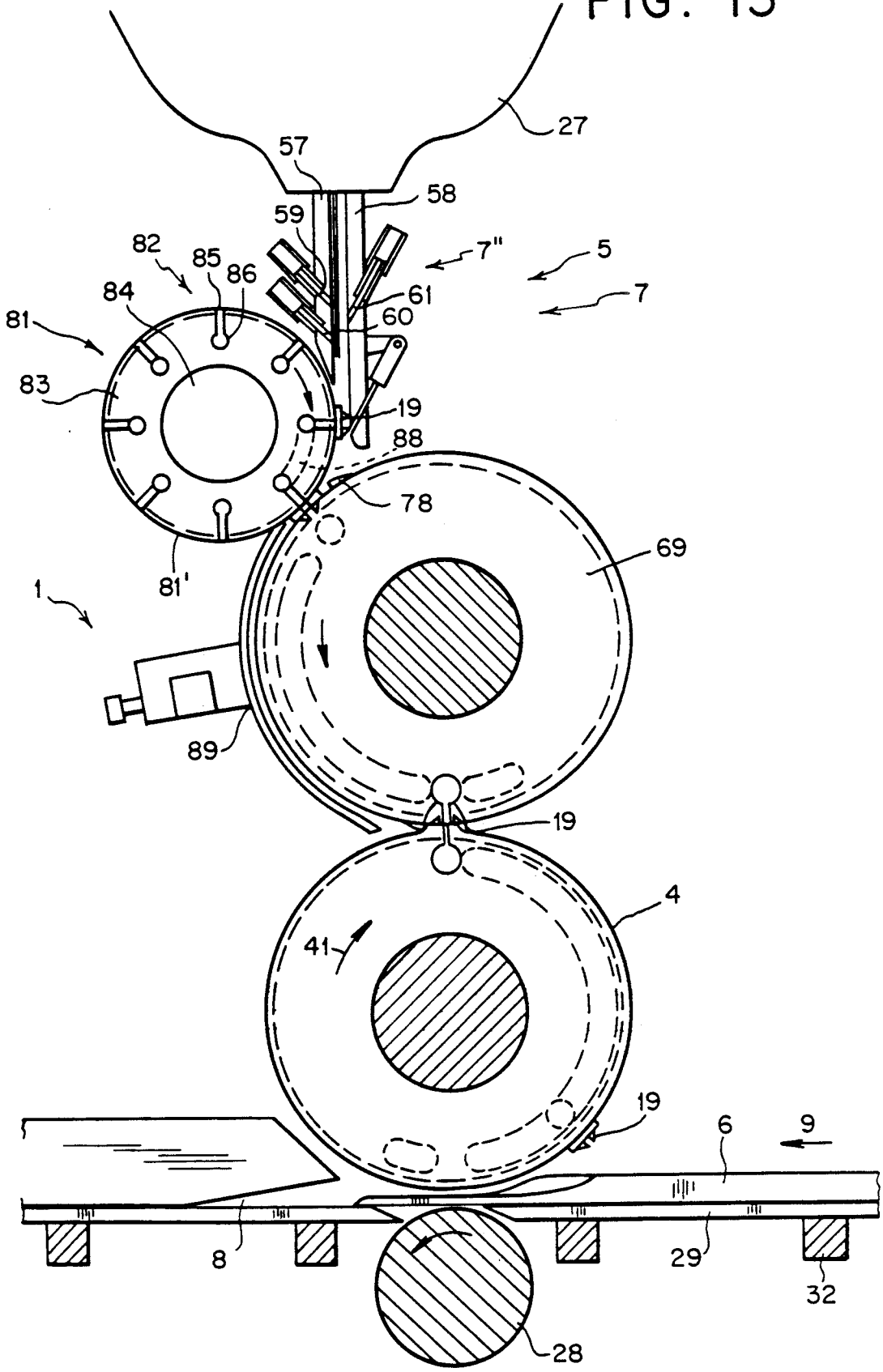
FIG. 13 is a side view of the apparatus with regulating cylinder and separating cylinder.
Figure 14:
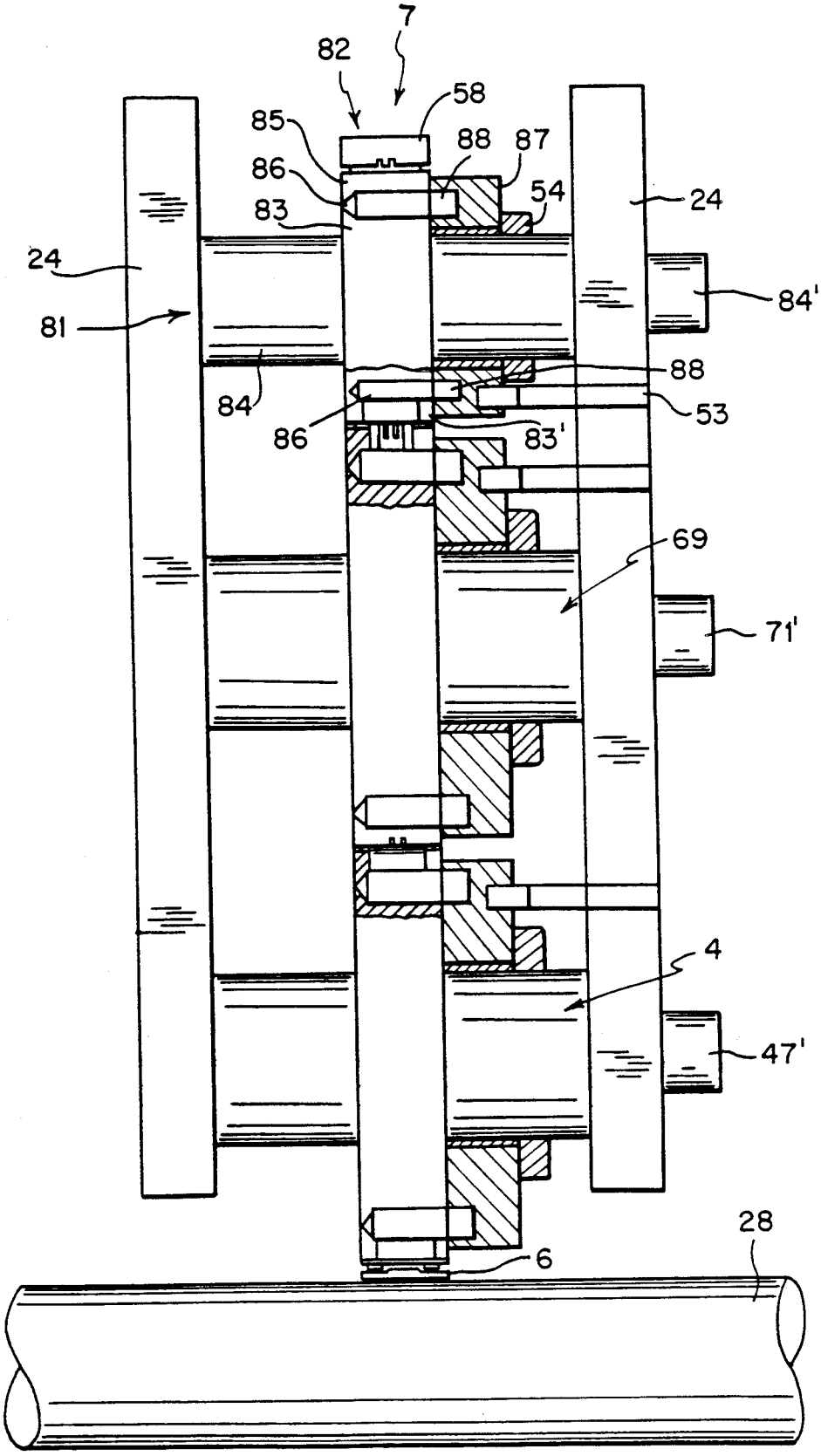
FIG. 14 is a cross-sectional view of the device of FIG. 13.

In yet another execution of apparatus 1, feed mechanism 5 additionally exhibits, as can be seen in FIGS. 13 and 14, a separating cylinder 81 which is arranged between a regulating cylinder 59 and guide 7. Separating cylinder 81, by means of a vacuum gripper mechanism 82, takes one clasp 19 at a time in charge whereupon said cylinder is stepped up in machine cadence by a specific angle of twist, holding clasp 19 ready to be taken in charge by regulating cylinder 69. Clasp 19 is only then released by gripper mechanism 82 when it has come to rest, already aligned, on entrainment means 78. Separating cylinder 81 displays a disk-shaped rotational body 83 which sits, in fixed position, on an axis 84 which rotates in a frame 24. Axis 84 is equipped with a driving pin 84' upon which a drive stepped in machine cadence (not shown) acts. Rotational body 83 exhibits several vacuum gripper devices 82, whereby one vacuum gripper mechanism 82, respectively, consists of a vacuum slot 85 which, serving as an air conduit is connected to a blind bore 86. Blind bore 86 is open toward one side 83' of rotational body 83. On axis 84 a control valve 87 for vacuum is located on the front side on side 83' and is held in fixed position vis-a-vis frame 24 by means of a fixture 53 while it is connected to axis 84 in a freely rotating manner, on which axis it is axially prevented from displacement by means of an adjusting ring 54. Control valve 87 exhibits only one vacuum duct 88 which duct is connected with a vacuum source (not shown) and which, during the rotating movement of separating cylinder 81 is connected to blind bore 86. Clasps 19 are seized by vacuum slots 85 and held and, when delivered over to regulating cylinder 69, pulled away from vacuum slot 85 by the regulating cylinder's entrainment means 78. The delivering over operation from regulating cylinder 69 to embossing roller 4 and the stamping operation are then performed as described hereinbefore.

While several embodiments of the present invention have been shown and described, it will be obvious that many changes and modifications may be made thereunto without departing from the spirit and scope of the invention.

What is claimed is:

1. A method for attaching metal clasps to letter envelopes in combination with an envelope forming machine for manufacturing letter envelopes, said clasps having anchoring elements and being attached to the letter envelopes as the letter envelopes are moved in a direction of conveyance by the envelope forming machine during their manufacture, said envelope forming machine having in the manufacture of the letter envelopes a means for folding the lateral flaps of the envelope blank to form the back side of the envelopes;

said method comprising: supplying said clasps in an uninterrupted succession from a supply magazine;

advancing said clasps by a feed mechanism to an embossing roller disposed in said envelope forming machine at the end of the folding operation and;

affixing said clasps by means of said embossing roller to the back sides of said envelopes; the affixing step including securing said clasps to the flaps forming the back sides of the letter envelopes with the anchoring elements of the clasps by means of a stationary support plate;

opposing said embossing roller, said stationary opposing support plate being gripped in tube-like manner between the front and back sides of the letter envelope; the clasps being securely fastened to the back side of the letter envelope only when the contacting lateral flaps of the envelope have been brought into final position with respect to each other.

2. The method according to claim 1, the securing step further comprising securing the clasps in an overlapping area of both lateral flaps of the letter envelope.

3. The method according to claim 1, comprising advancing the clasps to the letter envelopes, the securing step further comprising securely fastening the clasps to the envelope back sides in a direction of conveyance and at a speed which is equal to the speed and direction of conveyance that the letter envelopes are conveyed through the lateral flap-folding mechanism of the envelope forming machine.

4. The method according to claim 1, which further comprises separating out said clasps, from an uninterrupted succession of clasps by means of regulating vacuum and compressed air, halting said clasps and thereafter individually taking charge of said clasps by said embossing roller.

5. The method according to claim 1, which further comprises aligning said clasps prior to attachment to the back sides of the letter envelopes on a curved alignment track in side registration and in phase position.

6. The method according to claim 1, comprising bending back gradually the anchoring elements of said clasps during the attaching operation during which they are advanced in the direction of fold of the lateral flap-folding mechanism of the envelope forming machine.

7. In combination with an envelope forming machine for manufacturing letter envelopes, the envelope forming machine comprising means for conveying the envelopes and a lateral flap folding mechanism for folding lateral flaps of an envelope blank to form the back sides of the envelopes, the apparatus for attaching metal clasps having anchoring elements to the letter envelopes as the letter envelopes are moved in a direction of conveyance by the envelope forming machine conveying means during their manufacture and at the end of the folding operation, said apparatus comprising:

an advancing mechanism for said clasps having a guide and separating device;

an embossing roller to which said clasps are advanced;

an opposing support plate, said embossing roller and said opposing support plate being arranged in a fixed spatial relationship to each other at the downstream end of the lateral flap folding mechanism for affixing said clasps to the lateral flaps forming the back sides of the envelopes;

a carrier support and a fixture for securing said opposing support plate to said carrier support in an area within the lateral flap-folding mechanism of the envelope forming machine in which the lateral flaps do not yet overlap and that it extends from this area up into an area opposite the embossing roller;

said opposing support plate, at its downstream end opposite the embossing roller, is shaped like an anvil, and said opposing support plate during the attaching of the clasp telescopes with the anvil into the interior space of the letter envelope formed by the front and back sides thereof.

8. The apparatus according to claim 7, wherein said anvil tapers by means of an inner curvature from a recess to a final flattening.

9. The apparatus according to claim 7, wherein the inner curvature of the anvil and the outer casing of said embossing roller define a working gap therebetween.

10. The apparatus according to claim 7, wherein said anvil includes a mechanism to effect the gradual bending back of the anchoring elements of a clasp.

11. The apparatus according to claim 10, wherein said anvil includes two curve-shaped guide surfaces aligned in the direction of conveyance of the clasp which through inverse progressive rotation, evolve over, from their intake-surfaces, which are essentially arranged vertical to the recesses which are essentially parallel to each other into the horizontally aligned final flattening via outwardly slanting transition zones.

12. The apparatus according to claim 7, wherein a supporting element for the opposing support plate, in relation to a plane of advancement of the embossing roller in the form of guide plate and a cylinder, lies opposite thereto.

13. The apparatus according to claim 7, wherein said opposing support plate is strip-like in shape and its side directed away from the embossing roller is configured in such a way that it functions as a top guide for the front sides of the letter envelopes.

14. The apparatus according to claim 7, wherein said opposing support plate is arranged inside the lateral flap-folding mechanism of the envelope forming machine on a roller suspension frame.

15. The apparatus according to claim 7, wherein said opposing support plate is arranged on a pivoting bearing beam of the lateral flap-folding mechanism of the envelope forming machine by means of a fixture.

16. The apparatus according to claim 7, wherein said embossing roller includes on its casing a gripper mechanism which can be pressurized by means of vacuum and an entrainment means is arranged at a distance therefrom.

17. The apparatus to claim 7, wherein said embossing roller includes a mechanical gripper mechanism.

18. The apparatus according to claim 7, wherein the guide of the advancing mechanism is arranged such that it's downstream end is tangential to the embossing roller.

19. The apparatus according to claim 7, wherein a regulating cylinder is arranged inside the advancing mechanism between the guide thereof and the embossing roller which, at a distance from a gripper mechanism thereof, includes a mechanical entrainment means to align the clasps.

20. The apparatus according to claim 7, wherein a separating cylinder which is steppable with regard to machine cadence is arranged between the guide of the advancing mechanism and a regulating cylinder.

21. The apparatus according to claim 7, wherein the guide of the advancing mechanism is aligned tangentially at its downstream end to a casing and, in the downstream terminal area of the guide, on one side and spaced in the direction of conveyance, two vacuum jets are arranged which, on the other side of the guide and approximately axially thereto, are opposed by a compressed air jet.

22. The apparatus according to claim 21, wherein said vacuum jets can be distance adjusted with respect to each other.

23. The apparatus according to claim 21, wherein said vacuum jets can be pressurized by means of separately controlled vacuum and the compressed air jet can be supplied with controlled compressed air.

24. The apparatus according to claim 7, wherein said embossing roller includes a vacuum slot on its gripper mechanism providing form-locking reception of a back bead of the clasp.

25. The apparatus according to claim 7, wherein a braking apparatus is arranged at the downstream end of the guide of the advancing mechanism opposite the casing.

* * * * *